US005460448A

United States Patent [19]

Woolsey

[11] Patent Number: 5,460,448

[45] Date of Patent: Oct. 24, 1995

[54] PRECONDITIONING APPARATUS HAVING INTERMESHING BEATERS WITH A VARIABLE PITCH HELIX

[76] Inventor: Rick L. Woolsey, 1939 E. Sheridan Bridge La., Olathe, Kans. 66062

[21] Appl. No.: 224,685

[22] Filed: Apr. 8, 1994

[51] Int. Cl.[6] ..... B01F 7/04; B01F 15/06

[52] U.S. Cl. ..... 366/301; 366/149; 366/325.3; 366/327.1

[58] Field of Search ..... 366/66, 96, 97, 366/98, 99, 149, 291, 88, 297–301, 325, 326, 327, 329, 343, 323

[56] References Cited

U.S. PATENT DOCUMENTS

| | | | |
|---|---|---|---|
| 299,766 | 6/1884 | Farmer | 366/149 |
| 1,222,584 | 4/1917 | Barr | 366/99 |
| 1,411,103 | 3/1922 | Hughes | 366/97 |
| 1,767,102 | 6/1930 | Thorne | 366/297 |
| 2,673,802 | 3/1954 | Hansen | 366/149 X |
| 2,750,161 | 6/1956 | Simmons | 366/301 X |
| 3,332,368 | 7/1967 | Stickelber | 366/301 X |
| 3,334,873 | 8/1967 | Stickelber | 366/291 X |
| 3,640,509 | 2/1972 | Inamura et al. | 366/300 |
| 3,901,482 | 8/1975 | Kieffaber | 366/301 X |
| 3,938,783 | 2/1976 | Porter | 366/98 |
| 3,964,874 | 6/1976 | Maruko et al. | 366/149 X |
| 4,126,398 | 11/1978 | Phillips et al. | 366/168 X |
| 4,176,969 | 12/1979 | Wallace et al. | 366/149 |
| 4,281,934 | 8/1981 | Krause et al. | 366/300 X |
| 4,752,139 | 6/1988 | Hauck . | |
| 5,161,888 | 11/1992 | Hauck | 366/299 |

FOREIGN PATENT DOCUMENTS

| | | | |
|---|---|---|---|
| 1155731 | 10/1963 | Germany | 366/97 |

*Primary Examiner*—Charles E. Cooley

*Attorney, Agent, or Firm*—Kokjer, Kircher, Bowman & Johnson

[57] ABSTRACT

A device for conditioning feed materials such as flours, soy products, and the like has an elongated receptacle forming side-by-side intercommunicated cylindrical chambers of substantially equal diameter. Each chamber has a rotatable shaft extending longitudinally therethrough. Each shaft has a plurality of beaters extending radially from the shaft. A motor and gear assembly coupled to the shafts co-rotate the shafts. Upon co-rotation of the shafts, the beaters intermesh for mixing materials that have been introduced through an inlet of the preconditioner. In one embodiment, the beaters are oriented on the shafts such that selected beaters on one shaft sweeping feed materials in one direction (e.g., upwardly) advance the material substantially into selected beaters, located on the other shaft, sweeping feed materials in substantially the opposite direction (e.g., downwardly). This beater relationship provides a high degree of product shear and interference and product retention within the preconditioner. In another embodiment, the beaters are oriented to advance feed materials more rapidly near the inlet and outlet of the preconditioner by having a pitch of the helix formed by the beaters at the inlet and outlet being greater than a pitch of the helix formed by the beaters intermediate the inlet and outlet. Additionally, a substantially elliptical shroud surrounds the conditioning receptacle for forming a cavity into which steam for thermal heating may be introduced.

12 Claims, 4 Drawing Sheets

PRECONDITIONING APPARATUS HAVING INTERMESHING BEATERS WITH A VARIABLE PITCH HELIX

BACKGROUND OF THE INVENTION

1. Field of the Invention

The present invention is related generally to a preconditioning apparatus for mixing and hydrating farinaceous materials such as flours, soy products, and the like. More specifically, the present invention is related to a preconditioner for mixing materials such as those commonly used in breakfast cereals, snacks, and pet foods, the preconditioner having an elongate receptacle comprised of two substantially cylindrical intercommunicated chambers, each chamber having a shaft extending longitudinally through the chamber, the shafts having beaters thereon for mixing the feed material and advancing it from an inlet end of the preconditioner to an outlet end of the preconditioner. More specifically, the shafts co-rotate and the beaters are oriented on the shafts in a way to increase product shear, interference, and retention time within the preconditioning apparatus for providing thorough mixing and conditioning of materials.

2. Description of the Related Art

Preconditioners are widely known for mixing feed materials with injected steam or water prior to extrusion, pelleting, or other processing of the material. In general, a preconditioner includes an enclosed chamber having a rotating shaft extending through the chamber. Beaters extend from the rotating shaft for mixing the feed materials. Early preconditioners were single shaft models having an enclosed cylinder with a rotating shaft down the central axis. Beaters on the rotating shaft mixed the feed material while advancing it from an inlet end of the preconditioner to an outlet end.

More recent, conventional preconditioners include two side-by-side intercommunicated mixing chambers. Each cylindrical chamber is of substantially equal diameter and is provided with a counter-rotating shaft having radially extending beaters positioned thereon. In other words, one shaft rotates in a clockwise direction while the other shaft rotates in a counterclockwise direction. Feed materials introduced into the preconditioner are mixed by agitation resulting from the rotating beaters.

Attempts have been made to improve mixing through the dual shaft preconditioning devices. For instance, U.S. Pat. No. 4,752,139 discloses a preconditioner having a first chamber, large in diameter, including a rotating shaft with beaters for advancing products from the inlet to the outlet of the preconditioner and a second chamber, smaller in diameter, having a shaft rotating in the opposite direction from the shaft in the first chamber. The shaft in the smaller chamber rotates faster than the shaft in the larger chamber.

Various problems associated with preconditioning have not been resolved by prior art devices. The primary objectives of a preconditioner are to evenly mix and properly condition materials introduced into the preconditioner. While providing rapidly rotating beaters enhances mixture of the materials, it has the negative effect of advancing the materials too rapidly through the preconditioner, thereby preventing sufficient conditioning with liquid or steam. In contrast, providing slowly rotating beaters increases the retention time of the products in the conditioner, and therefore allows more sufficient time for the materials to be introduced to steam and fluids, but does not as sufficiently mix and agitate the materials, in addition to perhaps taking longer than desired for conventional, industrial purposes. Furthermore, the flours and other materials being mixed tend to accumulate on slowly rotating beaters, thereby reducing their effectiveness and the overall efficiency of the preconditioner.

Furthermore, a device as disclosed in the U.S. Pat. No. 4,752,139, described above, requires excessively complicated and expensive hardware. Additionally, since the shafts in such a device rotate at different speeds and in opposite directions, and furthermore are located in different sized chambers, materials introduced into such a preconditioner are not retained for even amounts of time. Accordingly, the resulting conditioned material is inconsistent and may not be completely, thoroughly mixed.

Accordingly, the need exists for an inexpensive, dual shaft preconditioner that is easy to manufacture. Additionally, there is a great need for such a preconditioner which provides substantially consistent product retention time for all materials introduced into the preconditioner. Additionally, the need exists for a preconditioner that can thoroughly and evenly mix and condition the materials introduced therein. The present invention fills these and other needs.

SUMMARY OF THE INVENTION

An object of the present invention is to provide a preconditioner which effectively retains materials in the preconditioner for an amount of time sufficient to evenly and thoroughly mix and condition the materials.

Another object of the present invention is to provide a dual shaft preconditioner which utilizes two shafts co-rotating at the same speed for mixing and conditioning materials.

Another object of the present invention is to provide a multiple shaft preconditioner that is inexpensive and easy to construct.

Another object of the present invention is to provide a preconditioner which prevents product build-up and provides uniform product flow at the inlet and outlet of the preconditioner by advancing materials more rapidly near the inlet and outlet of the preconditioner than at intermediate portions of the preconditioner.

Still another object of the present invention is to provide a dual shaft preconditioner with beaters that intermesh such that selected beaters on one shaft advances materials substantially into selected beaters on the other shaft during operation of the preconditioner.

A further object of the present invention is to provide a dual shaft preconditioner having intercalating beaters which enhance product shear and agitation.

These and other objects are achieved by a preconditioner comprised of an enclosed elongate receptacle having first and second intercommunicated substantially cylindrical chambers. Each chamber has a shaft extending longitudinally through a substantially central portion of the chamber. Each shaft is provided with a plurality of beaters extending radially from the shaft. A material inlet is provided at one end of the receptacle and an material outlet is provided at the opposite end of the receptacle. Ports are provided along the receptacle into which steam and liquids may be injected.

The beaters are oriented on the shafts such that the beaters on one shaft intermesh with the beaters on the other shaft during co-rotation of the shafts. Co-rotation of the shafts is accomplished by a motor and gear assembly. The beaters are further oriented such that selected beaters on one shaft advance material forward substantially into selected beaters on the other shaft. In other words, certain beaters on one shaft substantially block the flow of product being advanced by certain beaters on the other shaft. As a result, the flow of product within the preconditioner is interfered by selected beaters on one shaft immediately after the product is advanced by selected beaters on the other shaft. Accordingly, the product is momentarily restricted from advancing and is retained as a result of this interference, although net product flow is from the inlet to the outlet of the preconditioner.

In one preferred embodiment, each shaft contains radially outwardly extending beaters substantially evenly spaced along the length of the shaft. On each shaft, each successive beater is displaced further down the shaft and is oriented at 90° with respect to the immediately preceding beater. The starting position of the shafts having beaters thusly oriented is such that, upon co-rotation of the shafts, the odd numbered beaters on one shaft advance product in a path that is substantially disrupted by the even numbered beaters on the other shaft as the beaters intercalate during rotation of the shafts. The close passing of the beaters further causes the advancing material to be sharply swept from one general direction (e.g., upwardly) to generally an opposite direction (e.g., downwardly), thereby providing a high degree of product shear and agitation for improved mixing of ingredients.

In another embodiment, a selected number of beaters on each shaft at either the inlet end or outlet end of the preconditioner, or both, are oriented at 90° with respect to each other, with the remaining beaters oriented at 120° with respect to each other. However, the longitudinal displacement between any two successive beaters along the length of a shaft is preferably substantially the same, whether the beaters are oriented at 90° or 120° with respect to each other.

The less angle of orientation of beaters at an inlet or outlet end of the preconditioner causes these beaters to intermesh at a greater frequency than those beaters displaced at 120° thereby providing for more rapid product advancement within the cylindrical chambers at the inlet or outlet of the preconditioner relative to the region in the chambers associated with a lesser frequency of beaters. In this way, product back-up at the inlet and or outlet of the preconditioner is reduced or altogether prevented. In accordance with the principles of the present invention, the starting position of the shafts is such that, with respect to the beaters oriented at 120° the first, fourth, seventh and so on beaters thusly oriented on one shaft will force product substantially into the sweeping second, fifth, eighth, and so on beaters thusly oriented on the other shaft. This beater relationship provides increased product shear and retention within the preconditioner.

In accordance with other principles of the present invention, an enclosed cavity is provided around the preconditioning receptacle into which steam may be introduced. The cavity surrounding the intercommunicated cylindrical chambers of the preconditioner is configured with substantially continuously curved walls thereby providing a pressure vessel and a steam jacket useful for providing thermal heat to the chambers upon introduction of steam into the steam jacket.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
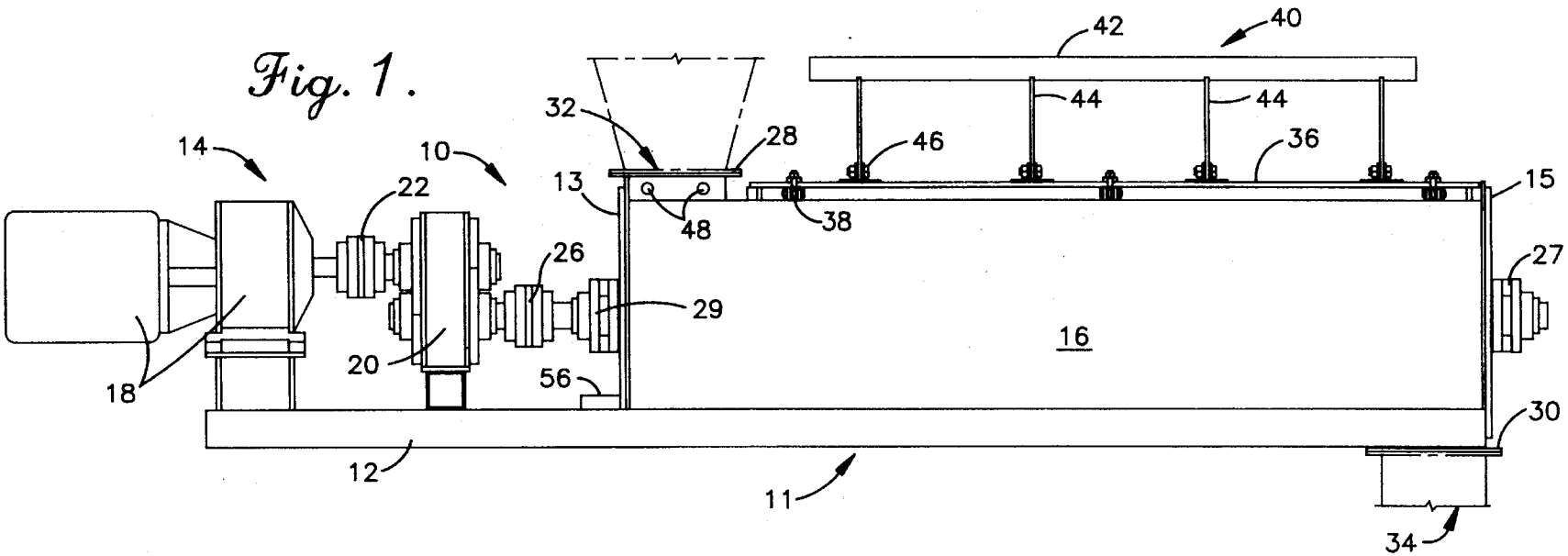
FIG. 1 is a side elevational view of the preconditioning apparatus of the present invention.
Figure 2:
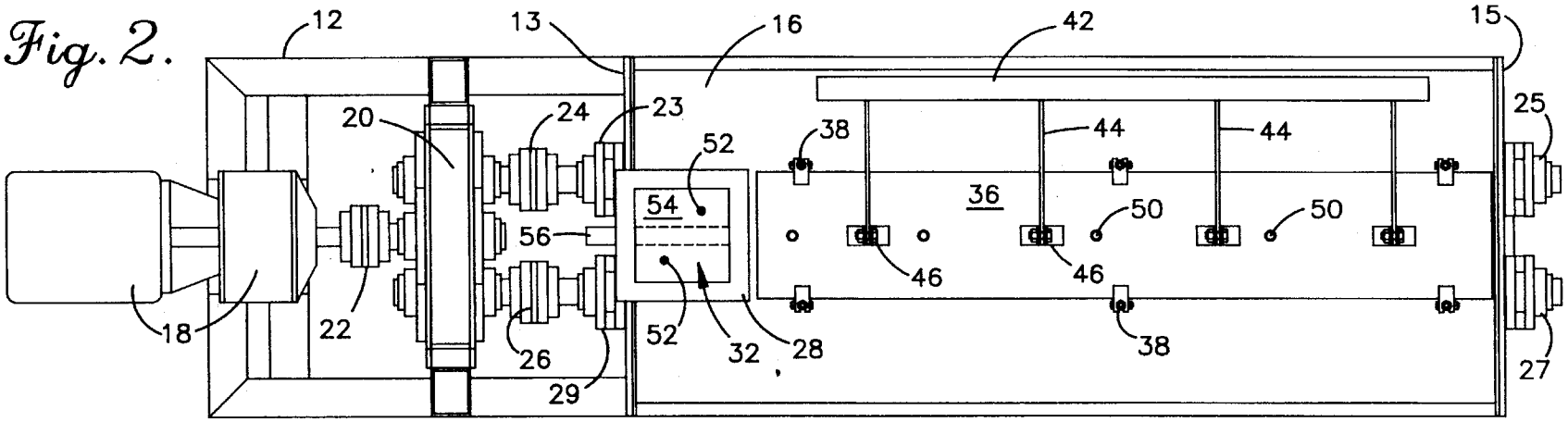
FIG. 2 is a top plan view of the preconditioning apparatus of the present invention.

With reference initially to FIGS. 1 and 2, the preconditioner of the present invention is denoted generally by the reference numeral 10. Preconditioner 10 is supported by a frame 12. Preconditioner 10 includes an elongate mixing receptacle 11. A motor and gear assembly, denoted generally by reference numeral 14 drives a pair of shafts extending longitudinally through elongate mixing receptacle 11 of preconditioner 10. End plates 13 and 15 cap the ends of receptacle 11.

Particularly, a motor 18 is coupled to gear box 20 by coupling 22. The motor 18 is preferably a gear motor providing some gear reduction. Additionally, the motor 18 may comprise a variable speed drive for driving the shafts at variable speeds. Gear box 20 is provided with gears for driving shafts located within preconditioner 10. Particularly, the output of gear box 20 has a first coupling 24 and bearing 23 to which one shaft within preconditioner 10 is connected, and the output of gear box 20 has a second coupling 26 and bearing 29 for driving a second shaft in preconditioner 10 connected therewith. As described more fully below, the shafts are rotationally mounted within the preconditioner. Specifically, the shafts are respectively mounted, at the end of the preconditioner 10 opposite the motor and gear assembly 14, to bearings 25 and 27.

Motor drives and gear assemblies will be readily understood by those skilled in the art. In accordance with the principles of the present invention, gear box 20 provides a co-rotating output such that coupling pairs 24, 26, and their respective shafts, co-rotate at the same speed. Particularly, each shaft rotates, in the same direction, the same number of revolutions per minute.

Preconditioner 10 has an inlet flange 28 and an outlet flange 30. Materials to be conditioned within preconditioner 10 are introduced into preconditioner 10 through inlet 32, normally from a screw or rotary feeder, as shown in broken lines in FIG. 1. The materials are mixed within the preconditioner 10 and advanced through preconditioner 10 to the outlet end thereof where the mixed materials exit preconditioner 10 through outlet 34. Inlet 32 and outlet 34 comprise passageways in communication with the interior of the conditioning receptacle 11 of preconditioner 10. It will be appreciated by those skilled in the art that the materials, once properly conditioned, are then introduced into other apparatus for further cooking and formation into the desired end product. For instance, feed or food material exiting preconditioner 10 may enter an extrusion cooker, where it is cooked prior to further processing, such as for instance, forming food or feed pellets.

A door 36 is located atop preconditioner 10 for providing access to the interior of preconditioner 10 for cleaning and maintenance purposes. When in place, door 36 is bolted down by bolts 38. A counter balance assembly 40 is provided for assisting in opening door 36, and maintaining door 36 in the open position. Counter balance assembly 40, which is preferably comprised of an elongate beam 42 supported a plurality of rod members 44, which are in turn pivotally attached at hinges 46, will be described in greater detail hereinafter.

Figure 5:
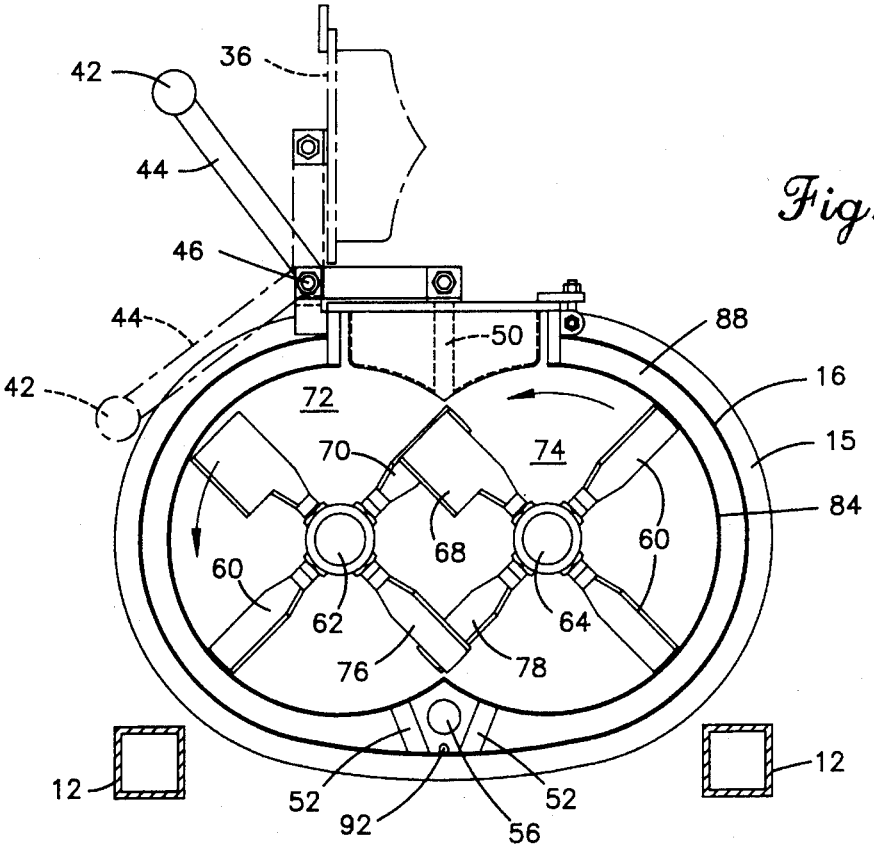
FIG. 5 is an end view of one embodiment of the preconditioner of the present invention with an removed for revealing the interior of the preconditioner.
Figure 7:
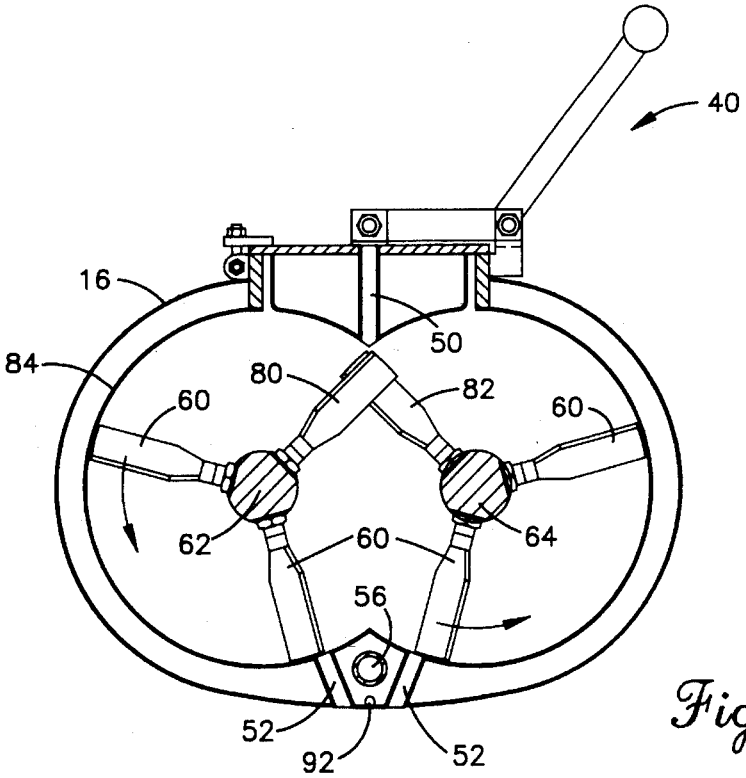
FIG. 7 is a cross sectional view taken along lines 7—7 of FIG. 6 having portions removed for clarity.

It will be appreciated by those skilled in the art, that during the conditioning process, liquids and steam may be introduced into preconditioner 10 for conditioning the materials to the desired mixture and consistency. As shown in FIG. 1, a pair of liquid injection ports 48 are provided just beneath inlet flange 28. Similarly, a plurality of liquid injection ports 50 are located in door 36. Hoses for carrying liquid to preconditioner 10 may be coupled to the liquid injection ports 48, 50. A plurality of steam injection ports 52 are provided in the bottom panel 54 of preconditioner 10. Steam may be introduced through steam injection ports 52 during the conditioning process. As shown in FIGS. 5 and 7, liquid injection ports 50 and steam injection ports 52 provide a passageway for steam to be introduced directly into receptacle 11, and particularly, the intercommunicated cylindrical chambers thereof.

An inlet 56 is provided for introducing steam into an external steam jacket, as described more fully below. The steam jacket provides a cavity located externally of the conditioning chambers of the present invention, between the chamber wall and the outer shroud, for providing and permitting steam to externally envelope the chambers. The resulting thermal heat assists the conditioning process.

Figure 3:
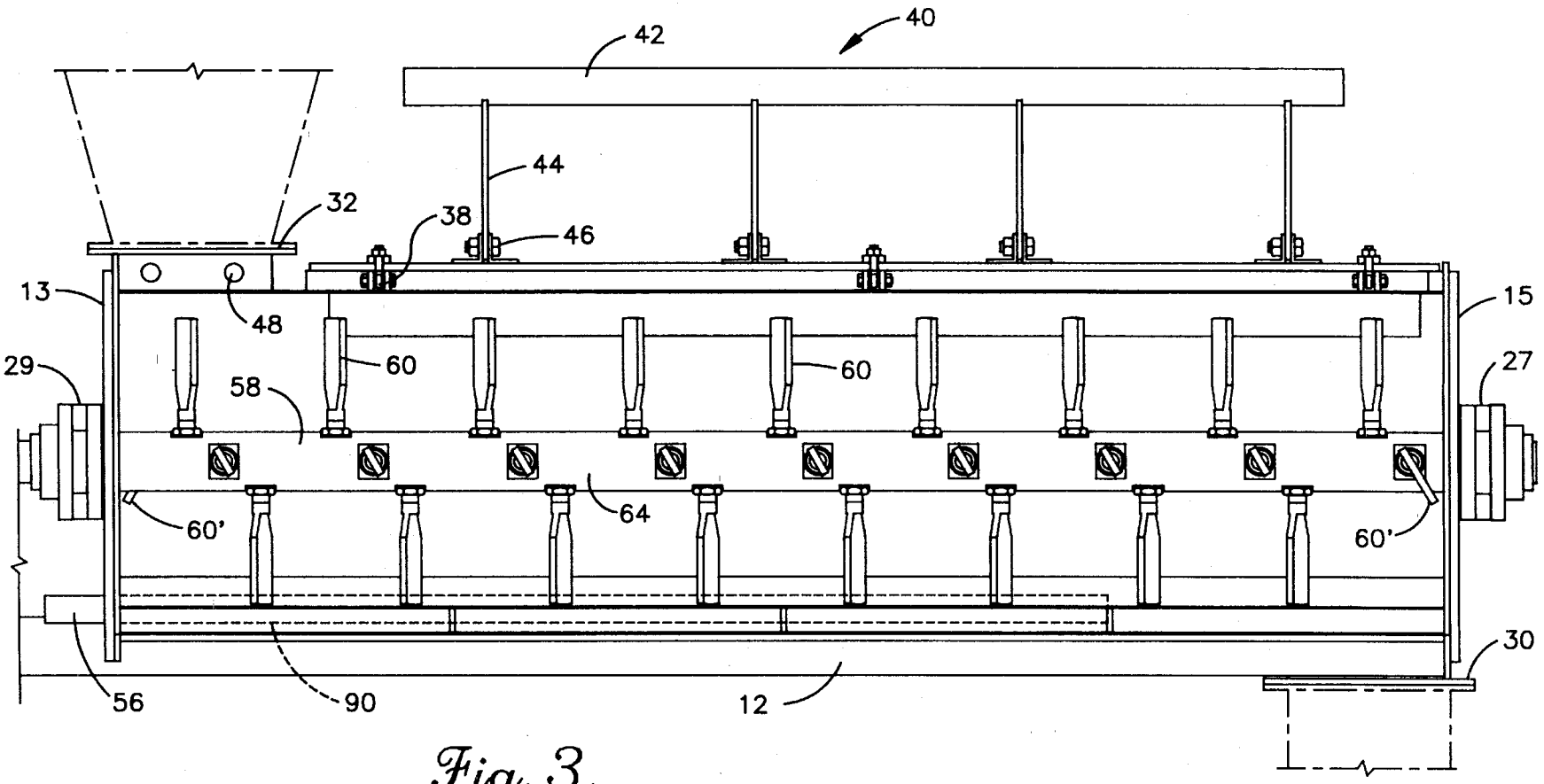
FIG. 3 is an enlarged side elevational view of the chamber portion of the apparatus of the present invention with the outer shroud and chamber wall removed for revealing the interior of the preconditioner.

Turning now to FIG. 3, preconditioner 10 is shown with outer shroud 16 and the wall 84 (See FIG. 5) forming the intercommunicated cylindrical chamber removed to reveal the interior of preconditioner 10. A pair of longitudinal shafts extend the length of the preconditioning chamber. A plurality of beaters 60 extend radially from each shaft. As shown in FIG. 3, a shaft 58 has a plurality of such beaters 60. It will be appreciated that the other shaft is located immediately behind the shaft 58, and therefore is not seen in FIG. 3. Upon rotation of shafts 58, beaters 60 assist in churning, and thereby mixing, materials introduced into preconditioner 10. The beaters 60 are preferably paddle-shaped and angled as shown for advancing material from the inlet end of preconditioner 10 to outlet 34. In the preferred embodiment, the first beater 60', or the last beater 60', or both, are wider than the other beaters 60. It should be appreciated that the angle, width, and size of selected beaters may be varied as desired.

Figure 4:
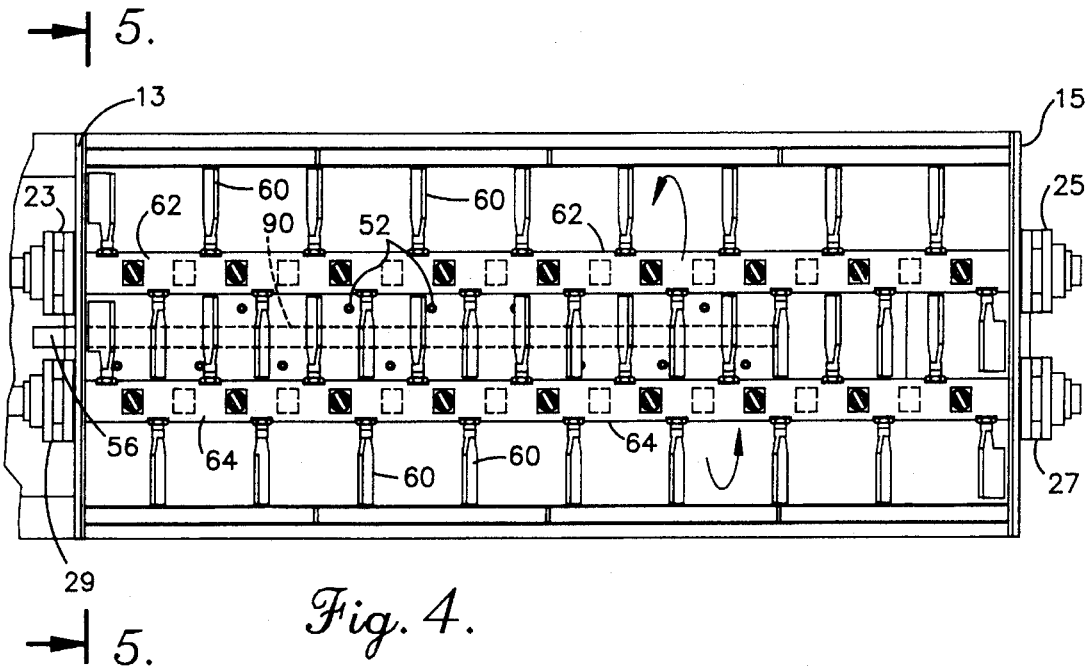
FIG. 4 is a top plan view of one embodiment of the preconditioning apparatus of the present invention, with the outer shroud and chamber wall removed for revealing the interior of the preconditioner.

As shown in FIG. 4, one preferred embodiment of the present invention comprises a first shaft 62 and a second shaft 64 extending longitudinally within preconditioner 10. A plurality of angled beaters 60 extend radially from each shaft. Preferably, the beaters 60 on each shaft are oriented about the shaft at 90° with respect to each other, with each successive beater 60 being located further down its respective shaft 62, 64, away from the inlet end of preconditioner 10. Preferably, longitudinal displacement along a shaft 62, 64 between beater locations is approximately two and one-half (2.5) inches. It will be appreciated that other beater displacements may be utilized. Accordingly, with respect to each shaft, a line drawn from beater tip to beater tip of the beaters 60 forms a helix. As shown in FIG. 4, beaters 60 are oriented on their respective shafts 62, 64 so that their starting locations are substantially identical. It should be appreciated that beaters 60 may be positioned on shafts 60, 62 in virtually any orientation, but in accordance with the preferred principles of the present invention, shafts 62 and 64 co-rotate to provide intermeshing of beaters 60 in a unique and highly desirable manner, and the starting orientation of the shafts 62, 64 and the position of beaters 60 must be such that the beaters 60 will not collide during co-rotation of the shafts 62, 64. As shown, the beaters 60 on one shaft 62 or 64 are dimensioned to pass in close proximity to the other shaft 62 or 64 during rotation of the shafts 62, 64. It should be understood that the overall number of beaters utilized and the length of the shaft may be varied as needed for a particular application or as desired.

As shown in the end view of preconditioner 10 in FIG. 5, with end plate 13 removed for revealing the interior of preconditioner 10, as shafts 62, 64 co-rotate in a clockwise direction, a first beater 68 on shaft 64 sweeps material within preconditioner 10 and forces it both generally upwardly in a clockwise direction and also forward through the preconditioner 10 toward the outlet 34 of the preconditioner 10. At approximately the same time, the second beater 70 on shaft 62 is passing just in front of the first beater 68 on shaft 64 in the manner shown in FIG. 5. This passage occurs at substantially the point at which intercommunicated cylindrical chambers 72, 74, through which shafts 62, 64 respectively extend, overlap. Similarly, a third beater 76 on first shaft 62, at the same time, passes just in front of the fourth beater 78 on second shaft 64. This intermeshing beater relationship, near the central portion of preconditioner 10, is repetitive along the length of the preconditioner 10 in connection with those beaters 60 further down the shafts toward the outlet end of preconditioner 10.

Accordingly, in the preferred beater relationship just described, as the shafts 62, 64 co-rotate, a first beater 68 on second shaft 64 advances material substantially into a second beater 70 on first shaft 62 at substantially an upper central portion of preconditioner 10 while a third beater 76 on first shaft 62 advances material substantially into a fourth beater 78 of second shaft 64 at a substantially central lower portion of preconditioner 10 near the point at which chambers 72, 74 intercommunicate. With reference again to FIG. 4, this intermeshing beater relationship is repeated along the length of the shafts extending through preconditioner 10.

The foregoing described beater relationship permits the shafts 62, 64 to be co-rotated at a relatively high rate of speed, thereby preventing buildup of material on the beater tips, while maintaining product retention as material advanced by certain beaters are immediately blocked by subsequent beaters, located on the opposite shaft, passing in the path of the flowing material. In addition to the product retention advantages of the beater relationship of the present invention, product shearing and interference is greatly enhanced. Particularly, for instance, material being swept by first beater 68 of second shaft 64 in a generally upward clockwise direction is immediately thereafter swept downwardly by second beater 70 of first shaft 62, thereby providing a high degree of product shear, interference and agitation. It is contemplated that the shafts could be co-rotated in either direction to achieve the purposes of the present invention.

With reference still to FIG. 5, preconditioner 10 is provided with an outer shroud 16. Intermediate outer shroud 16 and the wall 84 defining intercommunicated cylindrical chambers 72, 74 is a steam jacket 88. Particularly, outer shroud 16 is substantially elliptically configured like the wall 84 of receptacle 11. In other words, outer shroud 16 is an at least substantially continuously curved configuration. Accordingly, steam jacket 88 is a space substantially enveloping chambers 72, 74. Steam introduced into inlet 56 permits steam to fill steam jacket 88. The steam, which substantially externally surrounds chamber 72, 74, provides thermal heat for assisting in the conditioning process. The continuously curved nature of outer shroud 16 provides a pressure vessel subject to greater pressure strength than a shroud having flat surfaces. As shown in FIG. 4, steam entering inlet 56 passes through pipe 90 positioned beneath chambers 72, 74. A condensate opening 92 is provided at the bottom of steam jacket 88 for releasing condensate that has accumulated as a result of the steam. End plate 15, on the far end of preconditioner 10 as shown in FIG. 5, is also shown.

Steam injection ports 52, which permit steam to be introduced directly into chamber 72, 74, are also clearly shown in FIG. 5. It will be appreciated that the steam injected into the preconditioner through steam injection port 52 is unrelated to the external steam provided in steam jacket 88 for thermal heat.

The operation of door 36 and cross bar assembly 42 is also shown in FIG. 5. Particularly, once door 36 is unfastened, sufficient force applied to elongate beam 42 of counter balance assembly 40 to move the assembly from the solid lines shown in FIG. 5 to the dashed lines shown in FIG. 5, causes door 36 to pivot to an open position as shown in dashed lines. The counter balance assembly 40 is of a sufficient weight to maintain door 36 in an open position until a sufficient force is again applied to counter balance assembly 40, in an opposite direction, to close the door.

Figure 6:
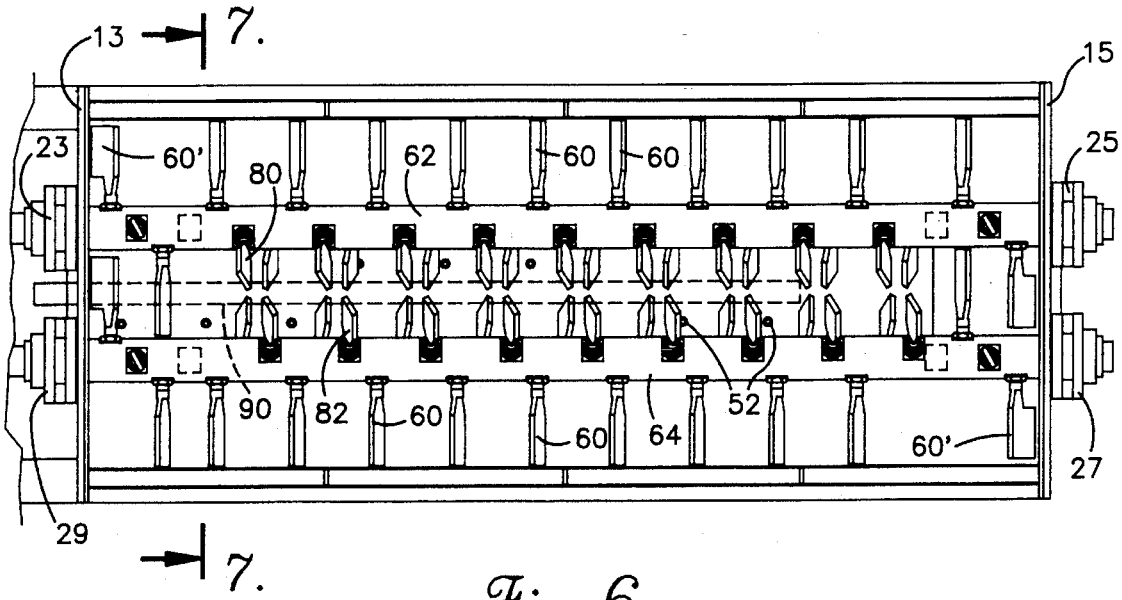
FIG. 6 is a top plan view of a second embodiment of the preconditioner of the present invention, the figure shown with an outer shroud and chamber wall removed for revealing the interior of the preconditioner.

With reference now to FIG. 6, a second preferred embodiment of the present invention is shown. Particularly, in FIG. 6, beaters 60 are provided on their respective shafts 62, 64 in the following manner. Each shaft 62, 64 has a first set of four beaters positioned at a 90° orientation with respect to each other like those of the embodiment shown in FIG. 4. Similarly, each shaft 62, 64 has a final set of four beaters 60 positioned at 90° intervals like those of the embodiment shown in FIG. 4. However, intervening beaters on each shaft are oriented at 120° about their respective shaft with respect to each other. The displacement between successive beater positions along the length of a shaft 62, 64 preferably remains substantially constant regardless of the angle of orientation between beaters 60 at particular successive beater positions. It should be understood that different angular orientation of beaters at the inlet or outlet end of preconditioner 10, relative to the intermediate portion thereof, may be accomplished with other numbers of beaters. For instance, the first six or eight beaters would be displaced at 90° angles from each other.

In the embodiment shown in FIG. 6, the lesser angle of orientation of beaters relative to each other near the inlet and outlet of preconditioner 10 foster more rapid product flow and help to prevent product backup at the inlet and outlet of preconditioner 10 because these beaters have a greater pitch than those beaters oriented at 120° relative to each other. These leading and trailing sets of four beaters 60 on each shaft are indexed like those shown in FIG. 4, and operate in the same manner. Similarly, the remaining beaters on shafts 62, 64 intercalate principally the same as in the embodiment shown in FIG. 4, although these beaters have a lesser pitch. Accordingly, the present invention provides for variable pitched shafts for providing greater product retention in the preconditioner at those regions having beaters oriented at a lesser pitch relative to the pitch of the helix formed by other beaters along the shafts. It should be understood that the beaters oriented at 120° relative to each other can be indexed at any position relative to the other beaters.

For instance, as shown in FIG. 7, as a first of the beaters spaced at 120° intervals, as denoted by reference numeral 80, is rotated about first shaft 62, a second beater 82 of second shaft 64 passes just in front of beater 80 at substantially an upper central portion of preconditioner 10 near a point at which cylindrical chambers 72, 74 intercommunicate. More specifically, in the embodiment shown, the first, fourth, seventh, and so on of the beaters 60 oriented at 120° from each other on one shaft force product to advance substantially into the second, fifth, eighth, and so on beaters oriented at 120° from each other on the other shaft during co-rotation of the shafts 63, 64. Accordingly, material being advanced by beater 80 is interrupted by beater 82, thereby providing product retention, interference, and shear. Accordingly, the describe beater orientation provides means for advancing product more rapidly through preconditioner 10 at desired regions within preconditioner 10, and preferably, at near the inlet and outlet thereof. FIG. 7 is a cross-sectional view for showing the orientation of those beaters positioned at 120° relative to each other. Those beaters near the outlet end of preconditioner 10 oriented at 90° relative to each other have been removed to provide clarity to the drawing.

In operation of preconditioner 10, farinaceous materials such as flours, soy products, and the like are introduced into preconditioner 10 through inlet 32. Motor 18 and gear box 20 operate to co-rotate shafts 62, 64 at an identical speed. As material enters preconditioner 10 at inlet 32, beaters 60 sweep the material about the interior of preconditioner 10 within intercommunicated cylindrical chambers 72, 74. As described above, the intermeshing relationship of beaters 60 of the present invention causes material advanced by certain beaters on a first shaft to be immediately and subsequently restricted from advancement by a beater positioned on a second shaft at a location just downstream from the inlet end of preconditioner 10. This intermeshing relationship is repetitive with selected, successive beaters of the shafts 62, 64.

During operation of preconditioner 10, liquid such as water may be introduced into conditioning receptacle 11, and particularly into intercommunicated cylindrical chambers 72, 74, through liquid injection ports 48 and/or 50. Steam may be introduced into the intercommunicated cylindrical chambers 72, 74 through steam injection ports 52. Also, steam for thermal heating may be provided externally of intercommunicated cylindrical chambers 72, 74 by introducing steam into steam jacket 88 through steam inlet 56.

In accordance with the principles of the present invention, shafts 62, 64 co-rotate at a constant, relatively high rate of speed to prevent product buildup on the beater tips, while providing product retention near the center of the preconditioner as a result of the interference of the intermeshing beaters. Furthermore, the shearing effect of the closely passing beaters in opposite directions provides a high degree of product shear and interference for adequately mixing the materials. Additionally, the resulting churning and spiraling effect on the material within preconditioner 10 yields a highly even mixture by the time it reaches the outlet end of the preconditioner 10.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A device for conditioning materials, said device comprising:

an elongate receptacle in which the materials are conditioned, said receptacle defining a pair of intercommunicated chambers;

a pair of rotatable shafts extending longitudinally through said elongate receptacle, each shaft having a plurality of beaters extending outwardly therefrom, said beaters of each shaft being oriented for intermeshing with the beaters of the other shaft upon rotation of the shafts, wherein said beaters are helically oriented on each said shaft, said beaters on each said shaft being substantially evenly displaced along the length of each said shaft, wherein a helix thereby formed by the beaters of each said shaft has a varying pitch, such that a pitch of the helix formed by a first plurality of beaters near at least one end of each said shaft is greater than a pitch of the helix formed by a second plurality of beaters on each said shaft; and means for rotating the shafts in the same rotational direction, thereby causing the beaters on one shaft to intermesh with the beaters on the other shaft.

2. A conditioning device as set forth in claim 1, wherein said shafts co-rotate at the same speed.

3. A conditioning device as set forth in claim 2 wherein said beaters are further oriented on said shafts such that selected beaters on one of said shafts advance materials being conditioned substantially into one of said beaters on the other of said shafts during co-rotation of the shafts and intermeshing of said beaters.

4. A conditioning device as set forth in claim 3 wherein said beaters on each said shaft have outwardly extending tips, wherein said beaters are oriented such that an imaginary line drawn along the outwardly extending tips of said beaters forms the helix, and whereby said beaters of each said shaft are designated numerically along the length of the shaft from which the beaters extend, wherein said beaters on each said shaft are oriented such that odd numbered beaters on said one of said shafts advance materials being conditioned substantially into respective even-numbered beaters on the other of said shafts during co-rotation of the shafts.

5. A conditioning device as set forth in claim 2 wherein each shaft has a first beater, and each said subsequent beater being oriented about its associated shaft at a preselected adjustable angle with respect to the immediately preceding beater, whereby co-rotating the shafts causes selected beaters on one of said shafts to substantially interrupt material being swept by selected beaters on the other of said shafts.

6. A conditioning device as set forth in claim 2 further comprising an inlet opening at substantially one end of said elongate receptacle and an outlet opening at substantially the opposite end of said elongate receptacle, whereby materials for conditioning enter said receptacle through said inlet opening and conditioned materials exit said receptacle through said outlet opening.

7. A conditioning device as set forth in claim 6 wherein said beaters are angled, with respect to a vertical plane extending perpendicularly through said receptacle, for generally advancing materials introduced into said receptacle through said inlet opening to said outlet opening of said receptacle upon rotation of said shafts.

8. A conditioning device as set forth in claim 2 further comprising a shroud covering spacially removed from said elongate receptacle thereby defining a cavity external of said elongate receptacle, said shroud being substantially elliptical in cross section.

9. A conditioning device as set forth in claim 8 further comprising an inlet providing a passageway for the introduction of steam into said external cavity.

10. A conditioning device as set forth in claim 1 wherein said pitch of the helix at each end of each said shaft is greater than the pitch of the helix formed by remaining beaters on the shaft.

11. A conditioning device as set forth in claim 10 wherein said pitch of the helix at each end of each said shaft is equal.

12. A device for conditioning materials, said device comprising:

an elongate receptacle in which materials are conditioned;

a rotatable shaft extending longitudinally through said elongate receptacle, said rotatable shaft having a first and second end, said rotatable shaft having a plurality of beaters extending outwardly from the shaft at selected positions along the length of said shaft for mixing materials to be conditioned, wherein said beaters are substantially evenly displaced along the length of said shaft, said shaft having a first plurality of beaters beginning at said first end of said shaft and a second plurality of beaters beginning at said second end of said shaft, each of said first plurality of beaters oriented in a helical fashion about said shaft with each successive beater oriented at approximately 90 degrees with respect to the immediately preceding beater in said first plurality of beaters, each of said second plurality of beaters oriented about said shaft in a helical fashion with each successive beater oriented at approximately 90 degrees with respect to the immediately preceding beater in said second plurality of beaters, said shaft further having a third plurality of beaters positioned along said shaft at a location intermediate said first and second plurality of beaters, said third plurality of beaters oriented about said shaft in a helical fashion with each successive beater of said third plurality oriented at approximately 120 degrees with respect to the immediately preceding beater in said third plurality of beaters; and means for rotating said shaft, whereby rotation of the shaft causes said beaters to mix materials to be conditioned.

* * * * *